US006951384B2

(12) United States Patent
Anderson et al.

(10) Patent No.: US 6,951,384 B2
(45) Date of Patent: Oct. 4, 2005

(54) INK JET HEATER CHIP AND METHOD THEREFOR

(75) Inventors: Frank Edward Anderson, Sadieville, KY (US); George Keith Parish, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 21 days.

(21) Appl. No.: 10/872,925

(22) Filed: Jun. 21, 2004

(65) Prior Publication Data

US 2004/0227791 A1 Nov. 18, 2004

Related U.S. Application Data

(62) Division of application No. 10/321,946, filed on Dec. 17, 2002, now Pat. No. 6,786,575.

(51) Int. Cl.[7] ..... B41J 2/05
(52) U.S. Cl. ..... 347/58
(58) Field of Search ..... 347/58, 63, 64, 347/57, 56, 55, 54, 20, 61

(56) References Cited

U.S. PATENT DOCUMENTS

| | | | |
|---|---|---|---|
| 4,532,530 | A | 7/1985 | Hawkins |
| 4,862,197 | A | 8/1989 | Stoffel |
| 4,947,192 | A | 8/1990 | Hawkins et al. |
| 4,951,063 | A | 8/1990 | Hawkins et al. |
| 5,081,473 | A | 1/1992 | Hawkins et al. |
| 5,157,418 | A | 10/1992 | Tamura |
| 5,844,586 | A | 12/1998 | Berry et al. |
| 5,883,650 | A | 3/1999 | Figueredo et al. |
| 5,980,025 | A | 11/1999 | Burke et al. |
| 6,013,160 | A | 1/2000 | Raisanen et al. |
| 6,120,135 | A | 9/2000 | Murthy et al. |
| 6,139,131 | A | 10/2000 | Prasad et al. |
| 6,252,617 | B1 | 6/2001 | Hasegawa et al. |
| 6,310,639 | B1 | 10/2001 | Kawamura et al. |
| 6,315,398 | B1 | 11/2001 | Burke et al. |
| 6,331,049 | B1 | 12/2001 | Leban |

FOREIGN PATENT DOCUMENTS

| | | |
|---|---|---|
| EP | 0 572 032 B1 | 12/1993 |

*Primary Examiner*—Raquel Yvette Gordon
(74) *Attorney, Agent, or Firm*—Luedeka, Neeley & Graham, P.C.

(57) ABSTRACT

An ink jet heater chip having improved thermal. The chip includes a semiconductor substrate, a first metal resistive, a second metal conductive layer on a first portion of the resistive layer and on a second portion of the resistive layer defining a heater resistor element. A passivation layer having a thickness defined by a deposition process is deposited on the second metal conductive layer and heater resistor element. A cavitation layer is deposited on the passivation layer and etched. A dielectric layer is deposited and etched to provide a dielectric layer overlying the first portion of the resistive layer. An electrical conduit via is etched in the dielectric layer. A third metal conductive layer is deposited in the via for electrical contact with the second metal conductive layer. Separately deposited dielectric and passivation layers enable independent control of the thickness of the dielectric and passivation layers.

14 Claims, 2 Drawing Sheets

INK JET HEATER CHIP AND METHOD THEREFOR

This application is a division of application Ser. No. 10/321,946, filed Dec. 17, 2002, now U.S. Pat. No. 6,786, 575.

FIELD OF THE INVENTION

The invention relates to ink jet heater chips and methods for the production of heater chips for ink jet printers.

BACKGROUND

Ink jet drop on demand printers are available in two main types, thermal ink jet printers and piezoelectric ink jet printers. The printheads for such printers may be configured as roof-shooters or side-shooters depending on the orientation of the nozzle holes with respect to the actuation devices which cause ink to be ejected through the nozzle holes. Thermal ink jet printers rely on resistive heating elements to heat ink and cause formation of a vapor bubble in an ink chamber adjacent the heating element which urges ink through an orifice toward the print media at an extremely rapid rate. High pressures generated in the ink chamber during the bubble formation and collapse can damage the heating elements during the life of the printhead. Accordingly, ink jet heater chips containing the heating elements as the ink ejection devices are typically fabricated with multiple layers of passivation and protection materials on the resistive heating elements.

As the speed of ink jet printers increases, the frequency of ink ejection by individual heating elements also increases thereby increasing the frequency of mechanical shock experienced by the heating elements. Increasing the thickness or number of protection material layers on the heating elements can increase the life of the printhead, however, the thermal efficiency of the heating elements suffers as the thickness or number of protection layers over the heating element increases. A need exists for ink jet heater chips having increased thermal efficiency and processes for making the heater chips which do not significantly increase printhead fabrication costs.

SUMMARY OF THE INVENTION

With regard to the foregoing, the invention provides an ink jet heater chip having improved thermal efficiency and method therefore. The chip is of the type which includes a semiconductor substrate, a first metal resistive layer on the substrate, a second metal conductive layer on a first portion of the resistive layer and on a second portion of the resistive layer defining a heater resistor element between the first and second portions of the resistive layer. A passivation layer having a first thickness defined by a deposition process alone is deposited on the second metal conductive layer and heater resistor element. A cavitation layer is deposited and etched adjacent the passivation layer overlying the heater resistor element and second portion of the resistive layer. A dielectric layer is deposited and etched to provide a dielectric layer having a second thickness overlying the first portion of the resistive layer. An electrical conduit via is etched in the dielectric layer. A third metal conductive layer is deposited and etched adjacent the dielectric layer and in the via for electrical contact with-the second metal conductive layer.

In another aspect the invention provides a method for improving the thermal efficiency of ink jet heater chips. The chips are of the type having a semiconductor substrate layer, a first metal resistive layer on the substrate layer, a second metal conductive layer on a first portion of the resistive layer, and the second metal conductive layer on a second portion of the resistive layer thereby defining a heater resistor element between the first and second portions of the resistive layer. The method includes the steps of:

- depositing a passivation layer on the heater resistor element and second metal conductive layer;
- depositing a cavitation layer on the passivation layer;
- etching the cavitation layer to expose a portion of the passivation layer overlying the first portion of the resistive layer;
- depositing an inter metal dielectric layer on the cavitation layer and exposed portion of the passivation layer;
- removing the dielectric layer over the heater resistor element and overlying the second portion of the resistive layer;
- etching a via in the dielectric layer and underlying passivation layer to provide an electrical connection conduit to the second metal conductive layer overlying the first portion of the resistive layer;
- depositing a third metal conductive layer in the via, adjacent the dielectric layer and adjacent the cavitation layer; and
- removing a portion of the third metal conductive layer overlying the heater resistor element and second portion of the resistive layer to provide a heater chip structure.

An important advantage of the invention is the ability to independently control the thicknesses of the passivation layer and dielectric layer so that the thermal efficiency of the heater resistor can be improved. The invention also enables control of the thickness of a passivation layer overlying a heater resistive element by a deposition process alone thereby avoiding passivation layer thinning steps, such as etching the passivation layer portion overlying the heater resistor element surface. The final thickness of the passivation layer overlying the heater resistor elements according to the invention can thereby be controlled by the deposition process used to provide the passivation layer rather than by a passivation and etch process which may result in variations in the passivation layer thickness from chip to chip. For electrical insulation purposes between conductive metal layers, a dielectric layer is provided by a separate deposition and etching process. The thickness of the separate dielectric layer may vary within wide limits since it does not increase the thermal inefficiency of the resistive heating element as described in more detail below. Use of a thinner passivation layer according to the invention provides a reduction in heater energy of about 20% or more.

For purposes of simplifying the description of the invention, the terms "passivation layer" and "dielectric layer" are used throughout. However it will be recognized that the dielectric layer and passivation layer may be provided by the same materials and serve similar purposes of electrically insulating and protecting the materials underlying these layers.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

DETAILED DESCRIPTION OF THE INVENTION

Figure 1:
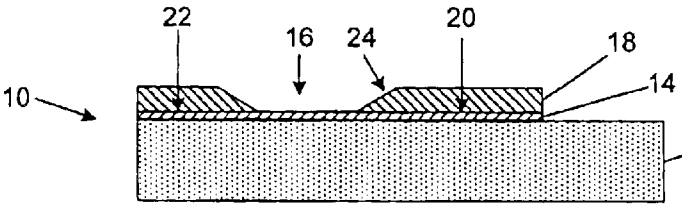
FIG. 1 is a cross-sectional view, not to scale, of a portion of a semiconductor substrate containing a resistive layer and a second metal conductive layer according to the invention.
Figure 2:
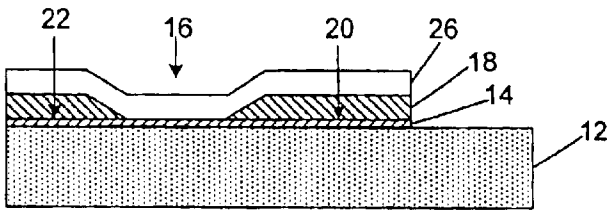
Fig. 2 PRIOR ART
FIGS. 2–5 provide illustration of steps of a process for making an ink jet heater chip according to a conventional process.
Figure 3:
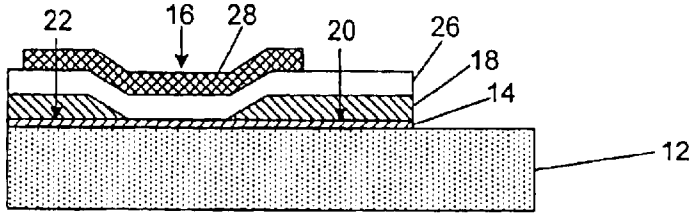
Fig. 3 PRIOR ART

With reference to FIGS. 1–3, a thermal ink jet heater chip 10 includes a semiconductor substrate 12 which may be doped or undoped and which may include NMOS or CMOS transistor devices formed therein according to a conventional process. For simplicity and ease of describing the invention, the steps of forming transistor devices in the substrate 12 will not be described. However, the invention is not limited to ink jet heater chips which do not contain transistor devices therein. The semiconductor substrate 12 preferably has a thickness ranging from about 300 to about 800 microns and provides support for the ink ejection elements and electrical conduction layers provided thereon.

A first metal providing a resistive layer 14 is deposited on a portion of the substrate 12, FIG. 1. While not shown, it is recognized that an insulation or overglaze layerof silicon dioxide oracomposite layer of silicon dioxide and phosphosilicate glass may be provided between the resistive layer 14 and the substrate 12. The first metal may be selected from tantalum, tantalum/aluminum alloys (TaAl), tantalum nitride (TaN), hafnium diboride (Hf $B_2$), zirconium diboride ($ZrB_2$), and the like. The preferred first metal is TaAl having a ratio of tantalum to aluminum in atomic percent ranging from about 40–60 to about 60–40. The resistive layer 14 typically has a thickness ranging from about 900 Angstroms to about 1200 Angstroms and is deposited by magnetron sputtering technique. As described in more detail below, the first metal provides, in combination with a second metal conductive layer, individual heater resistor elements 16.

A second metal conductive layer 18 is deposited, preferably by a magnetron sputtering process on the resistive layer 14. The second metal layer 18 may be provided by a wide variety of conductive materials, including, but not limited to, aluminum, aluminum copper (AlCu) alloys, aluminum-silicon-copper (AlSiCu) alloys, copper, gold, silver, tantalum, and the like. A preferred thickness for the second metal layer ranges from about 4000 to about 6000 Anastroms. After depositing the second metal layer 18, the first metal and second metal layer 18 are masked and etched in separate steps by conventional semiconductor etching processes, such as wet or dry etch techniques. The etched first metal provides the heater resistor elements 16 and the etched second metal layer 18 provides power and ground leads for the heater resistor elements 16. The order of etching the first and second metals is not critical, and may be conducted in any order.

The power and ground leads provided by the second metal layer 18 overly first and second portions 20 and 22 of the resistive layer 14 and define the heater resistor element 16 between the unetched portions of the second metal layer 18. An isotropic wet etch technique using a mixture of nitric and hydrochloric acids is preferred and provides the second metal layer 18 configured to preferably include a sloped conductor edge profile 24 (FIG. 1).

Afrer the power and ground leads and heater resistor elements 16 are defined in the resistive layer 14 and second metal layer 18, a passivation or inter metal dielectric material is deposited on the heater resistor element 16 and the second metal layer 18 to provide a passivation layer 26. The passivation layer 26 may be provided by a single layer of passivation material or preferably by a combination of layers of passivation materials. In a conventional printhead, the passivation layer 26 is provided by a silicon nitride ($Si_3N_4$) layer having a thickness ranging from about 4200 to about 4600 Angstroms and a silicon carbide (SiC) layer having a thickness ranging from about 2400 to about 2800 Angstroms. Hence, the total combined passivation layer thickness $T_1$ ranges from about 6600 to about 7400 Angstroms. The $Si_3N_4$ layer and SiC layer may be deposited on the heater resistor element 16 and second metal conducting layer 18 using a conventional chemical vapor deposition process such as plasma enhanced chemical vapor deposition (PECVD).

In a conventional printhead chip 10, the passivation layer 26 provides the entire insulation or inter metal dielectric layer overlying the second metal conductive layer 18 and the first portion 20 of the resistive layer 14. The main functions of the passivation layer 26 are to protect the heater resistor element 16 and second metal conductor layer 18 from the corrosive action of the ink used in the ink jet printer and to provide electrical insulation between metal layers. However, the passivation layer 26 is generally the most thermally inefficient layer and thus contributes significantly to the overall energy inefficiency of the heater resistors elements 16. Accordingly, in order to reduce the thickness of the passivation layer 26 overlying the heater resistor element 16, separate etching of the passivation layer 26 in the area overlying the heater resistor element 16 is performed. When the passivation layer 26 includes composite layers of SiC and $Si_3N_4$, etching of the passivation layer 26 is typically conducted using freon gas. Accordingly, the thickness $T_1$ of the passivation layer 26, in a conventional printhead manufacturing process, is controlled by a combination of depositing and etching the passivation layer 26.

Next a cavitation protection material is deposited and etched on the passivation 26 to provide a cavitation layer 28 (FIG. 3). The cavitation protection material may be selected from tantalum, tungsten, molybdenum and the like. The cavitation layer 28 preferably has a thickness ranging from about 4000 to about 6000 Angstroms and may be deposited as by conventional RF sputtering techniques. The cavitation layer 26 is then plasma and/or wet etched to remove the portion of the cavitation layer 26 overlying the first portion 20 of the resistive layer 14 thereby exposing a portion of the passivation layer 26 as shown in FIG. 3. In a conventional printhead having a passivation layer thickness T1, the passivation layer provides the entire insulation or inter metal dielectric layer overlying the second metal conductive material 18 and first portion 20 of the resistive layer 14.

It will be recognized that the cavitation layer 28 also contributes to the thermal inefficiency of the heater resistor element 16 and thus should be deposited with as small a thickness as required to provide protection of the heater resistor elements 16 over the life of the printhead. Likewise, materials having improved thermal conductivity for use as the cavitation layer 28 are contemplated by the invention in order to improve the overall efficiency of the heater resistor element 16. However, the invention is specifically directed to improvements in thermal efficiency by modification of the passivation layer as set forth below without limiting modifications to other layers which may effect thermal efficiency properties of the heater resistor element 16.

Figure 4:
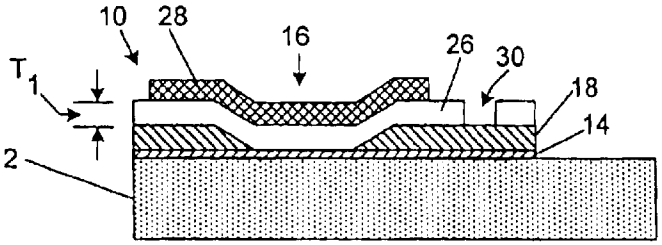
Fig. 4 PRIOR ART
Figure 5:
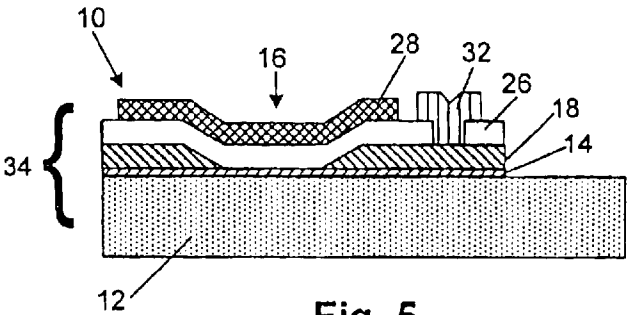
Fig. 5 PRIOR ART

Following provision of the cavitation layer 28, a path or electrical via 30 is preferably etched in the exposed portion of the passivation layer 26 to provide an electrical connection conduit for electrical contact between the second metal conductive layer 18 and a third conductive metal providing metal contact 32, (FIGS. 4 and 5). Etching of the passivation layer 26 to form via 30 may be conducted using freon gas as set forth above with respect to controlling the thickness of the passivation layer 26. The via 30 may have any useful shape including round, oval, square, rectangular, annular, and the like.

A third conductive metal material is then preferably deposited on the exposed portion of the passivation layer 26, the cavitation layer 28, and in the via 30 to provide electrical contact with the second metal conductive layer 18 at a location overlying the first portion 20 of the resistive layer 14. The excess third metal conductive material is then etched using a conventional photolithographic masking and etching technique to provide metal contact 32, FIG. 5. The third metal conductive material may be selected from a wide variety of conductive materials, including, but not limited to, aluminum, aluminum copper (AlCu) alloys, aluminum-silicon-copper (AlSiCu) alloys, copper, gold, silver, tantalum, and the like. The thickness of the third metal conductive layer preferably ranges from about 9,000 to about 11,000 Angstroms. The heater chip 10 illustrated by FIG. 5 preferably contains a heater stack 34 (FIG. 5) which preferably includes, the semiconductor substrate, the resistive layer 14, the first conductive layer 18, the passivation layer 26, the cavitation layer 28, the metal contact 32.

Figure 6:
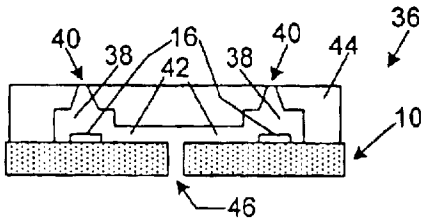
FIG. 6 is a cross-sectional view, not to scale, of a printhead containing a printhead chip made according to the invention.

Formation of a printhead 36 using the semiconductor chip then proceeds according to a conventional process to provide the printhead shown in FIG. 6. The heater resistor elements 16 and associated conductive and metal layers as described above are associated with ink chambers 38, nozzles 40, and ink feed channels 42 formed in a nozzle plate 44 material such as polyamide or in a thick film material, when a separate nozzle plate and thick film are used. The nozzle plate 44 is attached to the chip 10 to provide the printhead 36. An ink via 46 formed in the chip 10 provides a flow of ink from an ink reservoir attached to the printhead to the ink supply channels 42 and ink chambers 38 for heating by the resistor elements 16. Upon activation of the resistor elements 16, droplets of ink are expelled through the nozzles 40 toward a print media for forming an image thereon. The configuration of a printhead 36 using the printhead chips 10 made according to the invention is not is not critical to the invention and thus the printhead chips made according to the invention may be used in a wide variety of printheads.

With reference now to FIGS. 7–12, important features of the invention will now be described. FIGS. 1–3 above describe features of the invention with respect to deposition or formation of various resistive, conductive and protective layers on a semiconductor substrate 12. Accordingly, the formation of resistive layer 14 and conductive layer 18 on semiconductor substrate 12 for a printhead chip 50 or 70 made according to the invention are as described above. Likewise, the passivation layer 26 (FIG. 3) may be formed as described above, with the exception that a thinner passivation layer 52 having an overall thickness of T2 is preferably provided instead of a passivation layer 26 having a thickness of T1 wherein T1 is greater than T2. The preferred thickness of the passivation layer 52 ranges from about 3100 to about 4500 Angstroms. As above, the passivation layer 52 may be a provided by a combination of SiC and Si3N4 layers or any other suitable passivation and/or inter metal dielectric materials. When the passivation layer 52 is provided by a combination of SiC and Si3N4, the Si3N4 layer preferably has a thickness ranging from about 2200 Angstroms to about 3000 Angstroms and the SiC layer preferably has a thickness ranging from about 950 Anastroms to about 1450 Angstroms.

Figure 10:
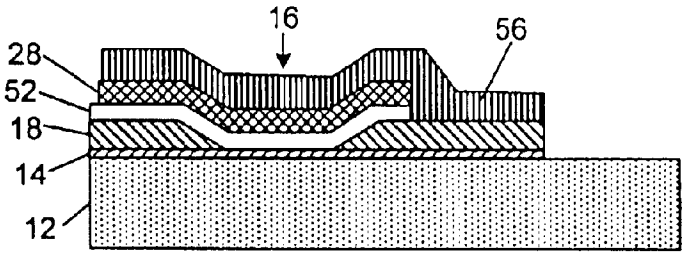
FIGS. 7–11 provide illustration of steps of a process for making a heater chip according to the invention.
Figure 11:
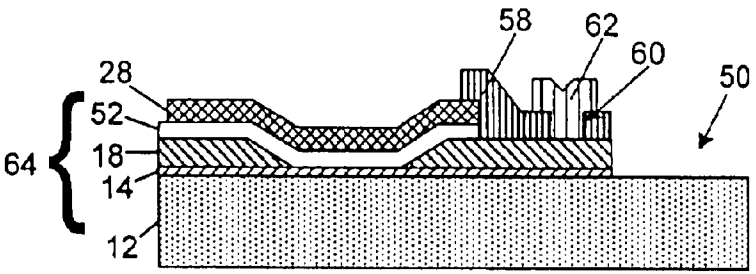
Figure 9:
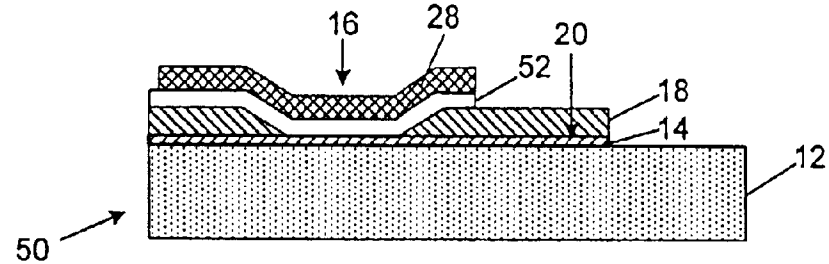

In one embodiment, illustrated in FIGS. 9–11, an exposed portion 54 of the passivation layer 52 (FIG. 8) is removed prior to depositing a separate inter metal dielectric or insulating material overlying the a portion of the second metal conductive layer 18 and first portion 20 of the resistive layer 14. In another embodiment, represented by FIG. 12, the exposed portion 54 of the passivation layer 52 is not etched off of the second metal conductive layer 18 and is used in conjunction with an inter metal dielectric material to provide suitable insulative properties between metal conductive layers of the heater stack.

Referring again to FIGS. 7–11, after the passivation material is deposited on the heater resistor element 16 and the second metal conductive layer 18, a cavitation layer 28, as described above is deposited on the passivation layer 52. The cavitation layer 28 is etched as described above to provide exposed portion 54 of the passivation layer 52. Using the same photolithographic mask used to define the cavitation layer 28 (FIG. 8), the exposed portion 54 of the passivation layer 52 is then removed from the second metal conductive layer 18 overlying the first portion 20 of the resistive layer 14 (FIG. 9). Etching of the passivation layer 52 may be conducted as described above.

Next an inter metal dielectric material is deposited over the entire metal layer 18 and cavitation layer 28 to provide an inter metal dielectric layer 56. The inter metal dielectric material may be selected from a wide variety of materials including, but not limited to, silicon nitride (Si3N4), spin on glass (SOG), phosphorus doped spin on glass (PSOG), silicon oxide, silicon oxide doped by phosphorus, and the like. The dielectric layer 56 may be provided by any organic or inorganic film material which is resistant to ink and has suitable insulative properties. The thickness of the dielectric layer 56 can vary within wide limits as it will be removed from the area overlying the heater resistor element 16 and generally will not be effective to increase the thermal inefficiency of the heater resistor element 16. A preferred inter metal dielectric layer 56 includes a silicon oxide layer having a thickness ranging from about 3200 to about 4800 Angstroms, a phosphorus doped spin on glass layer having a thickness ranging from about 1500 to about 2100 Angstroms, and a silicon oxide layer having a thickness ranging from about 3200 to about 4800 Anastroms. Regardless of the material selected for use as the inter metal dielectric layer 56, it is preferred that the layer 56 have a thickness of about 7000 Angstroms or more.

After the dielectric material is deposited to provide the dielectric layer 56, the dielectric layer is etched by conventional photolithographic techniques to provide a dielectric spacer 58 overlying the first portion 20 of the resistive layer 14 (FIG. 11). A via 60 is etched in the spacer 58 to provide an electrical connection conduit for electrical contact between the second metal conductive layer 18 and a third conductive metal providing metal contact 62, (FIG. 11). Etching the spacer 58 to form via 60 may be conducted as set forth above with respect to etching the dielectric 56 to form dielectric spacer 58. Like via 30, via 60 may have any useful shape including round, oval, square, rectangular, annular, and the like.

A third conductive metal material is then preferably deposited on the exposed portion of the dielectric spacer 58, the cavitation layer 28, and in the via 60 to provide electrical contact with the second metal conductive layer 18 overlying the first portion 20 of the resistive layer 14. The excess third metal conductive material is then etched using a conventional photolithographic masking and etching technique to provide the metal contact 62, FIG. 11. The third metal conductive material may be selected from a wide variety of conductive materials, including, but not limited to, aluminum, aluminum copper (AlCu) alloys, aluminum-silicon-copper (AlSiCu) alloys, copper, gold, silver, tantalum, and the like. The thickness of the third metal conductive layer preferably ranges from about 9,000 to about 11,000 Angstroms.

The heater chip 50 illustrated by FIG. 11 preferably contains the heater stack 64 which includes, the semiconductor substrate 12, the resistive layer 14, the first conductive layer 18, the passivation layer 52, the cavitation layer 28, the dielectric spacer 58, and the metal contact 62. Formation of an ink jet printhead using chip 50 is as described above with respect to chip 10 and FIG. 6.

Figure 12:
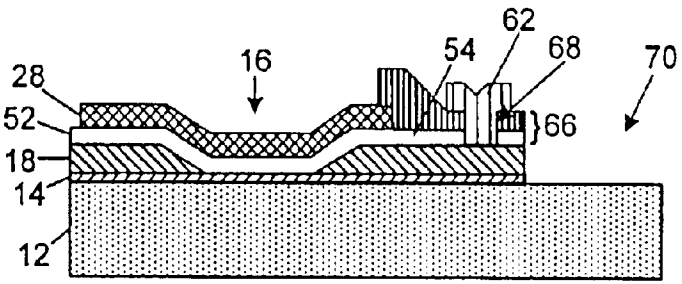
FIG. 12 is a cross-sectional view of a portion of a heater chip made according to another embodiment of the invention.
Figure 7:
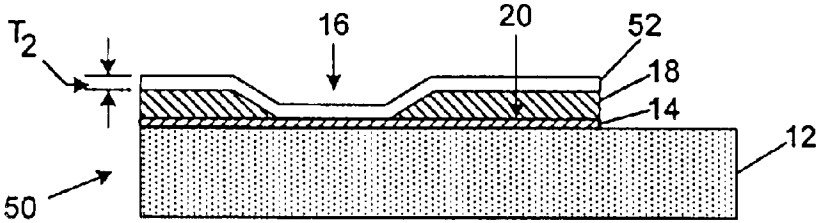
Figure 8:
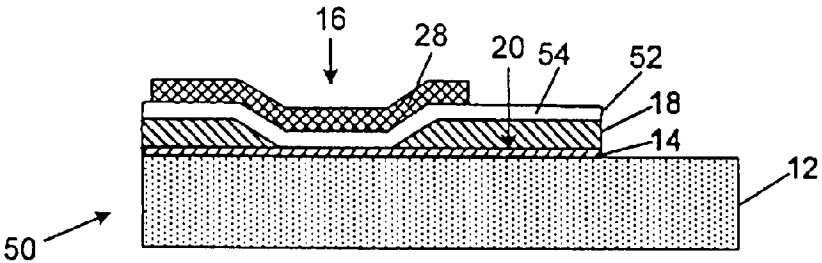

In an alternative process according to the invention, removal of the exposed portion of the passivation layer 54 overlying first portion 20 of the resistive layer 14 is omitted. Accordingly, the dielectric layer 56 is applied to the chip 50 of FIG. 8 so that the exposed portion 54 of the passivation layer 52 becomes a portion of the dielectric spacer 66 as shown in FIG. 12. Thus, via 68 is formed in the dielectric spacer 66 which includes the exposed portion 54 of the passivation layer 52. Metal contact 62 is then provided by depositing a third conductive metal and etching the metal as described above to provide the printhead chip 70.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A method for improving thermal efficiency of ink jet heater chips of the type having a semiconductor substrate layer, a first metal resistive layer on the substrate layer, a second metal conductive layer on a first portion of the resistive layer, and the second metal conductive layer on a second portion of the resistive layer thereby defining a heater resistor element between the first and second portions of the resistive layer, the method comprising the steps of:

depositing a passivation layer on the heater resistor element and second metal conductive layer;

depositing a cavitation layer on the passivation layer;

etching the cavitation layer to expose a portion of the passivation layer overlying the first portion of the resistive layer;

depositing an inter metal dielectric layer on the cavitation layer and exposed portion of the passivation layer;

removing the dielectric layer over the heater resistor element and overlying the second portion of the resistive layer;

etching a via in the dielectric layer and underlying passivation layer to provide an electrical connection conduit to the second metal conductive layer overlying the first portion of the resistive layer;

depositing a third metal conductive layer in the via, adjacent the dielectric layer and adjacent the cavitation layer; and removing a portion of the third metal conductive layer overlying the heater resistor element and second portion of the resistive layer to provide a metal contact for the heater chip.

2. The method of claim 1 wherein the passivation layer is deposited with a thickness ranging from about 3100 to about 4500 Angstroms.

3. The method of claim 1 wherein the cavitation layer is deposited with a thickness ranging from about 4000 to about 6000 Angstroms.

4. The method of claim 1 further comprising forming NMOS or CMOS transistors in the substrate prior to depositing the resistive layer on the substrate.

5. The method of claim 1 wherein the cavitation layer comprises tantalum.

6. The method of claim 1 wherein the inter metal dielectric layer is deposited with a thickness ranging from about 7900 to about 11,700 Angstroms.

7. The method of claim 1 further comprising forming a thermally grown insulation layer on the substrate layer between the substrate layer and the resistive layer.

8. A method for making an ink jet heater chip, of the type having a semiconductor substrate layer, a first metal resistive layer on the substrate layer, a second metal conductive layer on a first portion of the resistive layer, and the second metal conductive layer on a second portion of the resistive layer thereby defining a heater resistor element between the first and second portions of the resistive layer, the method comprising the steps of:

depositing a passivation layer on the heater resistor element and second metal conductive layer;

depositing a cavitation layer on the passivation layer;

etching the cavitation layer to expose a portion of the passivation layer overlying the first portion of the resistive layer;

removing the exposed portion of the passivation layer to expose a portion of the second metal conductive layer overlying the first portion of the resistive layer;

depositing an inter metal dielectric layer on the cavitation layer and exposed portion of the second metal conductive layer;

removing the dielectric layer over the heater resistor element and overlying the second portion of the resistive layer;

etching a via in the dielectric layer to provide an electrical connection conduit to the second metal conductive layer overlying the first portion of the resistive layer;

depositing a third metal conductive layer in the via, adjacent the dielectric layer and adjacent the cavitation layer; and removing a portion of the third metal conductive layer overlying the heater resistor element and second portion of the resistive layer to provide a heater chip structure.

9. The method of claim 8 wherein the passivation layer is deposited with a thickness ranging from about 3100 to about 4500 Angstroms.

10. The method of claim 8 wherein the cavitation layer is deposited with a thickness ranging from about 4000 to about 6000 Angstroms.

11. The method of claim 8 further comprising forming NMOS or CMOS transistors in the substrate prior to depositing the resistive layer on the substrate.

12. The method of claim 8 wherein the cavitation layer comprises tantalum.

13. The method of claim 8 wherein the inter metal dielectric layer is deposited with a thickness ranging from about 7900 to about 11,700 Angstroms.

14. The method of claim 8 further comprising forming a thermally grown insulation layer on the substrate layer between the substrate layer and the resistive layer.

* * * * *